US006516723B1

(12) United States Patent
Kündgen

(10) Patent No.: US 6,516,723 B1
(45) Date of Patent: Feb. 11, 2003

(54) PRINTING-PLATE CHANGER ASSEMBLY

(75) Inventor: Rolf Kündgen, Eppelheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/540,939

(22) Filed: Mar. 31, 2000

(30) Foreign Application Priority Data

Mar. 31, 1999 (DE) ..... 199 14 827

(51) Int. Cl.[7] ..... B41F 21/00; B41L 47/16
(52) U.S. Cl. ..... 101/477; 101/415.1; 101/216
(58) Field of Search ..... 101/477, 415.1, 101/378, 382.1, 383, 216

(56) References Cited

U.S. PATENT DOCUMENTS

| | | | | |
|---|---|---|---|---|
| 5,127,328 A | | 7/1992 | Wieland | 101/415.1 |
| 5,289,773 A | | 3/1994 | Saito et al. | 101/415.1 |
| 5,289,775 A | | 3/1994 | Spiegel et al. | 101/477 |
| 5,361,699 A | | 11/1994 | Compera | 101/477 |
| 5,440,988 A | * | 8/1995 | Ito | 101/415.1 |
| 5,460,092 A | * | 10/1995 | Beisel et al. | 101/415.1 |
| 5,613,438 A | | 3/1997 | Rehberg | 101/477 |
| 5,649,487 A | | 7/1997 | Zuber | 101/477 |
| 5,701,822 A | * | 12/1997 | Metrope | 101/477 |

FOREIGN PATENT DOCUMENTS

| | | |
|---|---|---|
| DE | 31 07 223 A1 | 1/1982 |
| DE | 42 24 832 C2 | 3/1993 |
| DE | 42 14 047 C2 | 4/1994 |
| DE | 44 02 158 C1 | 2/1995 |
| EP | 0 433 798 A2 | 6/1991 |
| JP | 4-284252 | 10/1992 |

* cited by examiner

*Primary Examiner*—Leslie J. Evanisko
(74) *Attorney, Agent, or Firm*—Laurence A. Greenberg; Werner H. Stemer; Ralph E. Locher

(57) ABSTRACT

A printing-plate changer assembly for making-ready and feeding printing plates to a plate cylinder of a printing unit, the assembly including a printing-plate changer located upline of the printing unit, in a position for feeding the printing plates, and being articulatedly connected to the printing unit by at least two four-bar linkages so that it is pivotable upwardly into a swung-away position for servicing work, includes at least one element articulatedly connected with the printing unit and with the printing-plate changer so that it holds the printing-plate changer in both the feeding and the swung-away positions and assists the pivoting movement.

17 Claims, 5 Drawing Sheets

PRINTING-PLATE CHANGER ASSEMBLY

BACKGROUND OF THE INVENTION

FIELD OF THE INVENTION

The invention relates to a printing-plate changer assembly for making ready and feeding printing plates to a plate cylinder of a printing unit, the assembly including a printing-plate changer located upline or in front of the printing unit, in a position for feeding the printing plates, and being articulatedly connected to the printing unit by at least two four-bar linkages so that it is pivotable upwardly into a swung-away position for servicing work.

A printing-plate changer of the foregoing general type has become known heretofore from the published European Patent Document EP 0 433 798 A2. This printing-plate changer is fixed to a lower portion of a printing unit guard and is pivotable upwardly together with the latter by two four-bar linkages. A disadvantage of this printing-plate changer is that a locking mechanism is required for the aforementioned positions, which must be locked and unlocked, respectively, separately by mechanical or electrical control or by hand. This applies particularly to the swung-away position located at the top, because the performance of service work calls for a high level of safety. In addition, the action of pivoting into the upper end position requires an expenditure of a great amount of force.

SUMMARY OF THE INVENTION

It is accordingly an object of the invention to provide a printing-plate changer assembly of the type described at the introduction hereto that is held securely and automatically in the positions thereof and is easily bringable into the swung-away position.

With the foregoing and other objects in view, there is provided, in accordance with the invention, a printing-plate changer assembly for making-ready and feeding printing plates to a plate cylinder of a printing unit, the assembly including a printing-plate changer located upline of the printing unit, in a position for feeding the printing plates, and being articulatedly connected to the printing unit by at least two four-bar linkages so that it is pivotable upwardly into a swung-away position for servicing work, comprising at least one element articulatedly connected with the printing unit and with the printing-plate changer so that it holds the printing-plate changer in both the feeding and the swung-away positions and assists the pivoting movement.

In accordance with another feature of the invention, the at least one element is formed as a sprung element and is articulated and aligned offset with respect to the articulations of the four-bar linkages, so that it urges the printing-plate changer downwardly into the position for feeding the printing plates and upwardly into the swung-away position, as well as away from a given pivoting angle.

In accordance with a further feature of the invention, a plurality of the elements are disposed on both sides of the printing-plate changer.

In accordance with an added feature of the invention, the at least one element is a gas pressure spring.

In accordance with an additional feature of the invention, the printing-plate changer serves to replace a printing unit guard, and the printing unit is accessible for substantially all servicing work due to the pivoting action.

In accordance with yet another feature of the invention, the printing-plate changer assembly includes an active element for performing the pivoting movement.

In accordance with yet a further feature of the invention, the printing-plate changer assembly includes two upper levers and two lower levers for providing articulation.

In accordance with yet an added feature of the invention, the printing-plate changer has a substantially two-dimensional extent, and the assembly includes a plurality of articulations formed so that the printing-plate changer completes the pivoting in a semicircle lying in the plane of the two-dimensional extent of the printing-plate changer.

In accordance with yet an additional feature of the invention, the printing-plate changer has a substantially two-dimensional extent, and the assembly includes a plurality of articulations formed so that the printing-plate changer completes the pivoting in a semicircle lying perpendicularly to the plane of the two-dimensional extent of the printing-plate changer.

In accordance with still another feature of the invention, the printing-plate changer assembly includes a synchronization shaft for connecting at least one lever pair to another at an articulation.

In accordance with still a further feature of the invention, the printing-plate changer is also constructed for holding the printing plates after they have been used.

In accordance with still an added feature of the invention, power is introducible into the printing-plate changer in a region of the axes of rotation.

In accordance with still an additional feature of the invention, power is introducible via at least one clutch.

In accordance with an alternative feature of the invention, power is introducible via gearwheels intermeshing in a closed state.

In accordance with another feature of the invention, the printing-plate changer assembly includes a locking device for securing the intermeshing of the gearwheels.

In accordance with a further feature of the invention, the printing-plate changer assembly includes a printing-plate conveying device disposed in the printing-plate changer.

In accordance with an added feature of the invention, the printing-plate conveying device has a pressure roller and a back-pressure roller which are pressable against one another by spring force, with a printing plate included therebetween.

In accordance with an additional feature of the invention, the printing-plate changer assembly includes a motor for driving the printing-plate conveying device, the motor being disposed on the printing unit.

In accordance with a concomitant feature of the invention, the printing-plate conveying device has a free wheel for permitting a printing plate to be drawn in by rotation of the plate cylinder.

Thus, the object is achieved in that at least one element is constructed and articulated on the printing unit and printing-plate changer so that it holds the printing-plate changer in both positions and assists the pivoting movement.

Printing-plate changers in this sense can be automatic, semi-automatic or also make-ready devices for improved manual feeding.

Due to the configuration according to the invention of the printing-plate changer, a secure hold in all positions is achieved. In particular, assurance is provided that the printing-plate changer remains in the upper swung-away position thereof even when vibration occurs. As a result, in particular, work safety during servicing work is increased in a simple and reliable manner, and there is no requirement for a separate locking device with separate locking and/or unlocking, particularly in the swung-away position. Due to the assistance provided to the pivoting movement, the printing-plate changer according to the invention is particularly suitable for manual operation. However, performing the pivoting movement automatically is also possible, of course. In this case, a less powerful drive is required. The printing-plate changer and the pivoting mechanism are of compact construction, and a synchronous movement sequence and weight compensation are possible in a simple manner.

One embodiment of the invention provides for the element to be formed as a sprung element and to be articulated and aligned offset with respect to the articulations of the four-bar linkages so that it urges the printing-plate changer downwardly into the position for feeding the printing plates and upwardly in the swung-away position, as well as from a specific pivoting angle. The elements can be arranged on both sides of the printing-plate changer. The sprung element is expediently a gas pressure spring or strut, because this offers the additional advantage that the movement sequence is damped. This is particularly advantageous when the printing-plate changer is pivoted into the lower position thereof, because this movement sequence is assisted by the weight, and the printing-plate changer should be prevented from sharply striking the printing unit.

The printing-plate changer is advantageously constructed so that it completely replaces the printing unit guard, provision being made for such a pivoting action that, thereby, the printing unit is accessible for virtually all servicing work. In this manner, a separate printing unit guard can be completely dispensed with.

If the printing-plate changer is also particularly suitable for manual operation, due to the compact construction thereof and due to the assistance thereby to the pivoting movement, it is nevertheless possible for an additional active element to be provided which performs the pivoting movement.

The at least two four-bar linkages can be configured so that the articulation is provided by two upper levers and two lower levers. The articulation can be formed so that the printing-plate changer completes the pivoting action in a semicircle which lies in the plane of the two-dimensional extent of the printing-plate changer. In this case, the axes of the articulations are perpendicular to this plane, and the pivoting movement goes to the side and then upwardly in a semicircle so that the levers complete a pivoting movement through about 180°.

Another embodiment provides for the articulations to be formed so that the printing-plate changer completes the pivoting action in a semicircle which lies perpendicular to the plane of the two-dimensional extent of the printing-plate changer. In this case, the axes of the articulations extend in the plane of the printing-plate changer, and ensures that at least one pair of levers in an articulation is connected to another by a synchronization shaft. In this way, a synchronous movement sequence is ensured over the entire width of the printing-plate changer. The levers are pivoted through about 180° in this embodiment as well.

In both of the aforementioned exemplary embodiments, the pivoting angle due to which the sprung element urges the printing-plate changer upwardly is determined in accordance with the articulation of the changer. The offset of the articulation of the sprung element with respect to the articulations of the levers is expediently such that a force component is produced upwardly the instant the printing-plate changer has been pivoted through 90°, so that the assistance to the pivoting movement by the sprung element begins from this instant of time. This offset of the articulations also includes such an oblique positioning of the sprung element that the latter runs obliquely from bottom to top when the levers are in a horizontal position and, consequently, the force component can be developed upwardly. This is expedient precisely when the printing-plate changer is pivoted manually, because the upper range of the pivoting action is more laborious to perform manually.

A further development of the printing-plate changer provides for the latter also to be constructed so as to hold the printing plates after they have been used. For this purpose, a used printing plate is pushed by the plate cylinder into an ejection shaft of the printing-plate changer for used printing plates and then, if appropriate, is taken over by a withdrawal clip, which pulls the used printing plate completely out of the printing machine, so that the printing plate is stored in the ejection shaft for removal.

Power is expediently introduced into the printing-plate changer in the region of the axes of rotation, it being possible for the power to be introduced electrically or mechanically. The arrangement in the region of the axes of rotation is expedient in particular for cables or for compressed air or hydraulic hoses. However, the mechanical introduction of power can also be performed via a clutch or coupling. The advantage of the mechanical, pneumatic or hydraulic introduction of power is that no motor has to be arranged in the printing-plate changer, and the latter can therefore be of more lightweight construction. The motor can be provided at a different location in the printing machine.

An embodiment of a clutch calls for power to be introduced via gearwheels which intermesh in the closed state. For the case wherein the gear mechanism forces pressing the gearwheels apart are too great for the sprung element, provision can be made for the position of the printing-plate changer to be secured, in the closed state, by an additional locking device. However, this merely has a supporting function and not a function specific to safety, as in the prior art mentioned at the introduction hereto.

A printing-plate conveying device can be arranged in the printing-plate changer, and can be supplied with power in the manner mentioned above. One possibility of configuring the printing-plate delivery device is that a pressure roller and a back-pressure roller are pressed against one another by spring force, including a printing plate, so that the printing plate is conveyed by the rotation of the rollers. The printing-plate conveying device can then be driven by a motor arranged on the printing unit. The printing-plate conveying device expediently has a free wheel, which permits the printing plate to be drawn in by rotation of the plate cylinder. This is expedient, because the leading edge of the printing plate is gripped by a clamping device of the plate cylinder and further conveyance is then intended to be performed by rotation of the plate cylinder, in order to wind the printing plate cleanly around the latter.

Other features which are considered as characteristic for the invention are set forth in the appended claims. Although the invention is illustrated and described herein as embodied in a printing-plate changer assembly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
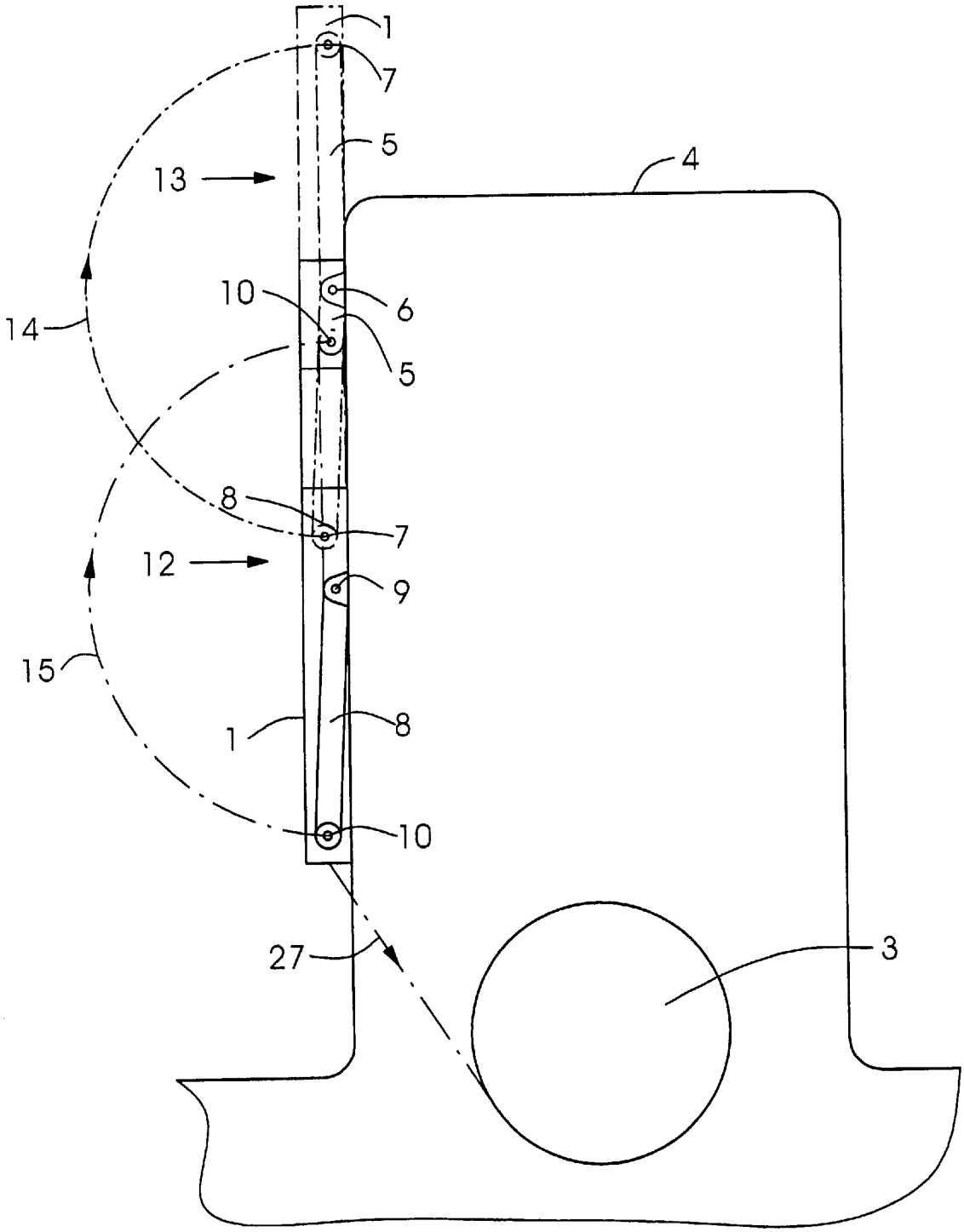
FIG. 1 is a basic sketch in a diagrammatic side elevational view of a printing unit with a printing-plate changer for illustrating one possibility for articulatedly connecting the latter to the former with four-bar linkages.

Referring now to the drawings and, first, particularly to FIG. 1 thereof, there is shown therein a basic sketch of a printing unit 4 with a printing-plate changer 1. This basic sketch illustrates one possibility of articulatedly connecting the printing-plate changer 1 to the printing unit 4 with a four-bar linkage 5 to 10 so as to form a printing-plate changer assembly. For the purpose of simplifying the illustration in the interest of clarity, an element 11 which holds the printing-plate changer 1 in the two positions 12 and 13 and assists the pivoting movement has been omitted from FIG. 1. In this regard, however, reference is made to FIGS. 2 to 4 wherein the element 11 is clearly shown. The printing-plate changer 1 is articulatedly connected to the printing unit 4 on each side thereof with an upper lever 5 and a lower lever 8. In this regard, the upper levers 5 have an articulating connection 6 with the printing unit 4 and an articulating connection 7 with the printing-plate changer 1. In addition, the lower levers 8 have an articulating connection 9 with the printing unit 4 and an articulating connection 10 with the printing-plate changer 1. In the position 12 of the printing-plate changer 1 for feeding the printing plates, the printing unit 4 is closed at a front side thereof. In this position 12, the printing-plate changer 1 serves simultaneously as a printing unit guard. For servicing work, the printing-plate changer 1 is conveyed into a swung-away position 13, by being pivoted upwardly in a semicircle and assuming the position 13 shown in phantom, i.e., by dot-dash lines. In order to illustrate these pivoting movements, the pivoting path of the articulating connections 7 has been shown by a dot-dash semicircle 14, and the pivoting path of the articulating connections 10 have been shown by a dot-dash semicircle 15. During this pivoting action, the levers 5 and 8 are pivoted through an arc of about 180°, by rotation about the articulating connections 6 and 9 on the printing unit 4.

The feeding of a printing plate 2 to the plate cylinder 3 is further indicated by the arrow 27 in FIG. 1.

Figure 2:
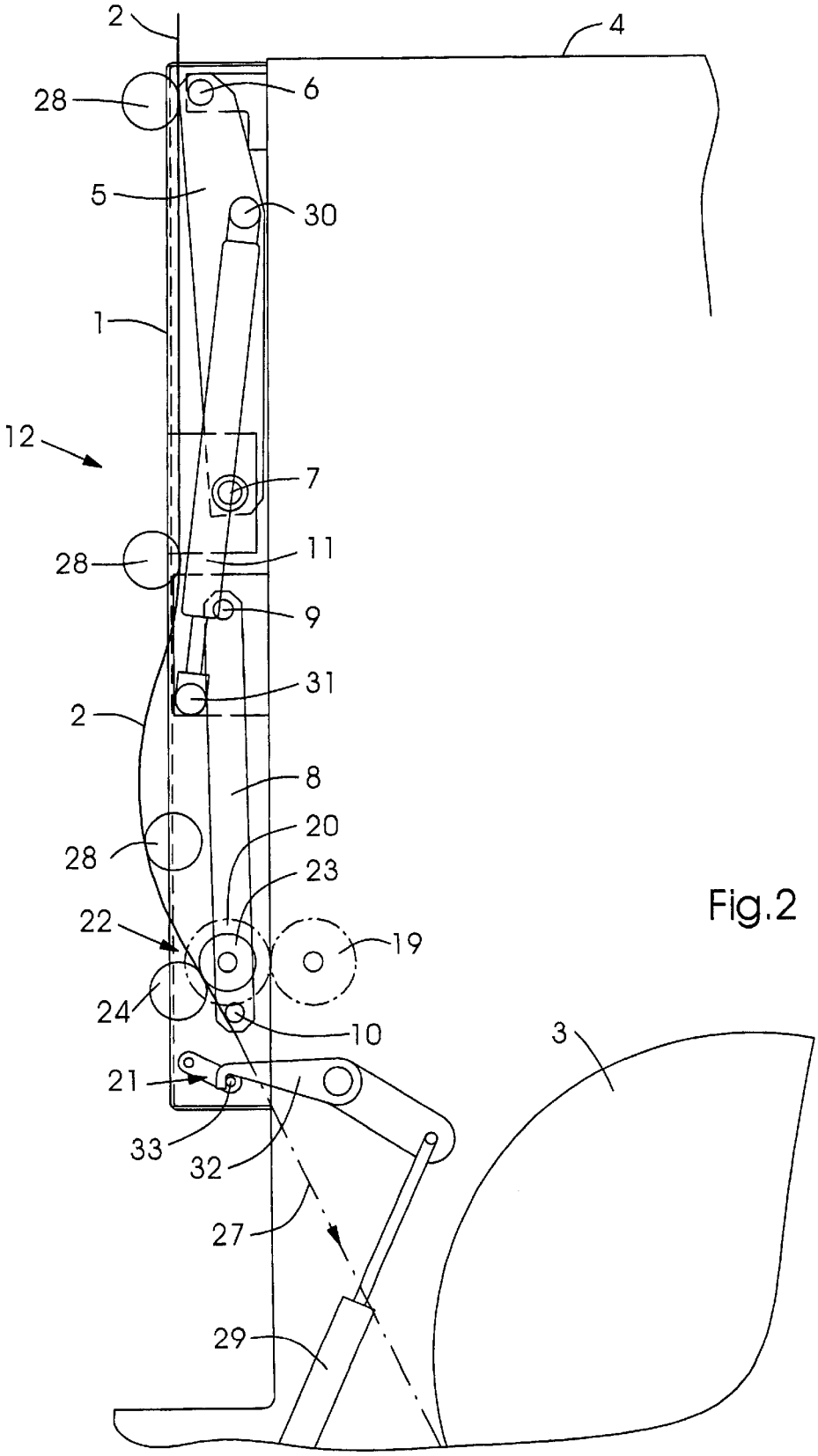
FIG. 2 is a fragmentary enlarged view of FIG. 1, showing an exemplary embodiment of the printing-plate changer assembly according to the invention in closed condition.

FIG. 2 shows an exemplary embodiment of the invention, the printing-plate changer 1 being articulated on the printing unit 4 in the manner described hereinbefore with respect to FIG. 1 and, as described, being pivotable from the position 12 into the pivoted position 13.

FIG. 2 also shows the disposition of a sprung element 11, which is expediently formed as a gas pressure or compression spring or strut. This offers the advantage that the printing-plate changer 1 is braked as it is pivoted down into the position 12 and, as a result, the printing-plate changer 1 is prevented from sharply striking the printing unit 4. In the position 12 shown for the feeding of printing plates, the force of the gas pressure spring 11 is directed substantially downwardly and therefore ensures the stability of this position. If the pivoting movement described with respect to FIG. 1 into the swung-away position 13 is performed, then, beginning at a specific pivoting angle, a force component of the gas pressure spring 11 is produced upwardly and, at the same time, assists the pivoting operation. For this purpose, the gas pressure spring 11 is articulated with the articulated connection 30 thereof to the printing unit 4 and the articulated connection 31 thereof to the printing-plate changer 1 offset with respect to the levers 5 and 8, and is provided with an oblique alignment. As a result, when the printing-plate changer 1 is pivoted through 90°, the articulation 31 of the gas pressure spring is located farther up than the articulation 30, due to which an upwardly directed force component occurs and consequently assists the pivoting operation in this upper region. This is particularly expedient when the printing-plate changer 1 is operated manually, because, in the lower pivoting region, i.e., in the first 90°, a resistance can be overcome considerably more easily by hand than during the farther upward pivoting movement. Besides assisting this pivoting movement, however, the force of the gas pressure spring 11 in the swung-away position 13 effects a secure hold in this position and, even in the case of relatively severe vibrations, there is no danger that the printing-plate changer 1 will fall down from the swung-away position 13 and endanger the service personnel. When the printing-plate changer is pivoted downwardly from the swung-away position 13 into the position 12, the gas pressure spring 11 counteracts the movement, beginning at a specific angle, and as a result prevents the printing-plate changer 1 from sharply striking the printing unit 4.

Also shown in FIG. 2 is a printing plate 2 which is located in the printing-plate changer 1. It is the make-ready position before a printing-plate change is performed. Printing-plate guide rollers 28 are arranged for holding and guiding the printing plate 2, and a printing-plate conveying device 22 is provided for feeding a printing plate 2 in the direction of the arrow 27 to the plate cylinder 3. This device includes a pressure roller 23 and a back-pressure roller 24, which are pressed against one another, with a printing plate 2 included therebetween. Located in the printing unit 4 is a motor 25, which drives a gearwheel 19 in the printing unit 4, the gearwheel, in turn, meshing with a gearwheel 20 in the printing-plate changer 1. This gearwheel 20 drives the pressure roller 23 so as to transport the printing plate 2 in the direction of the arrow 27 to the plate cylinder 3. Because intermeshing gearwheels develop forces which are directed away from one another, an additional locking device 21 is provided, wherein a pneumatic cylinder 29 hooks a lock 32 into a pin 33 and in this manner holds the printing-plate changer 1 securely on the printing unit 4 in the lower region thereof. Of course, the necessity for such a locking device 21 depends upon how powerful the transmission of force through the gearwheels 19, 20 is, and how much can be held by the gas pressure spring 11. This locking device 21, however, is provided only for the lower position 12 of the printing-plate changer 1. In the upper swung-away position 13, which is relevant to safety, securing by the element 11 is quite adequate.

During the printing-plate change, the printing plate 2 is moved in the direction of the plate cylinder 3 by the rotation of the pressure roller 23 and by running along with the back-pressure roller 24, as shown by the arrow 27. The leading edge of the printing plate 2 is then inserted into a non-illustrated leading-edge clamping device in the plate cylinder 3, and clamped in and then fitted to the plate cylinder 3 by rotation of the latter. In this regard, a free wheel 26 ensures that the pressure roller 23 and the back-pressure roller 24 can move independently of the gearwheels 19 and 20, so that the draw-in of the printing plate 2 is not impeded.

An ejection shaft 34 for used printing plates can further be provided in the printin-plate changer 1, but this has not been shown in FIG. 2 in the interest of clarity.

Figure 3:
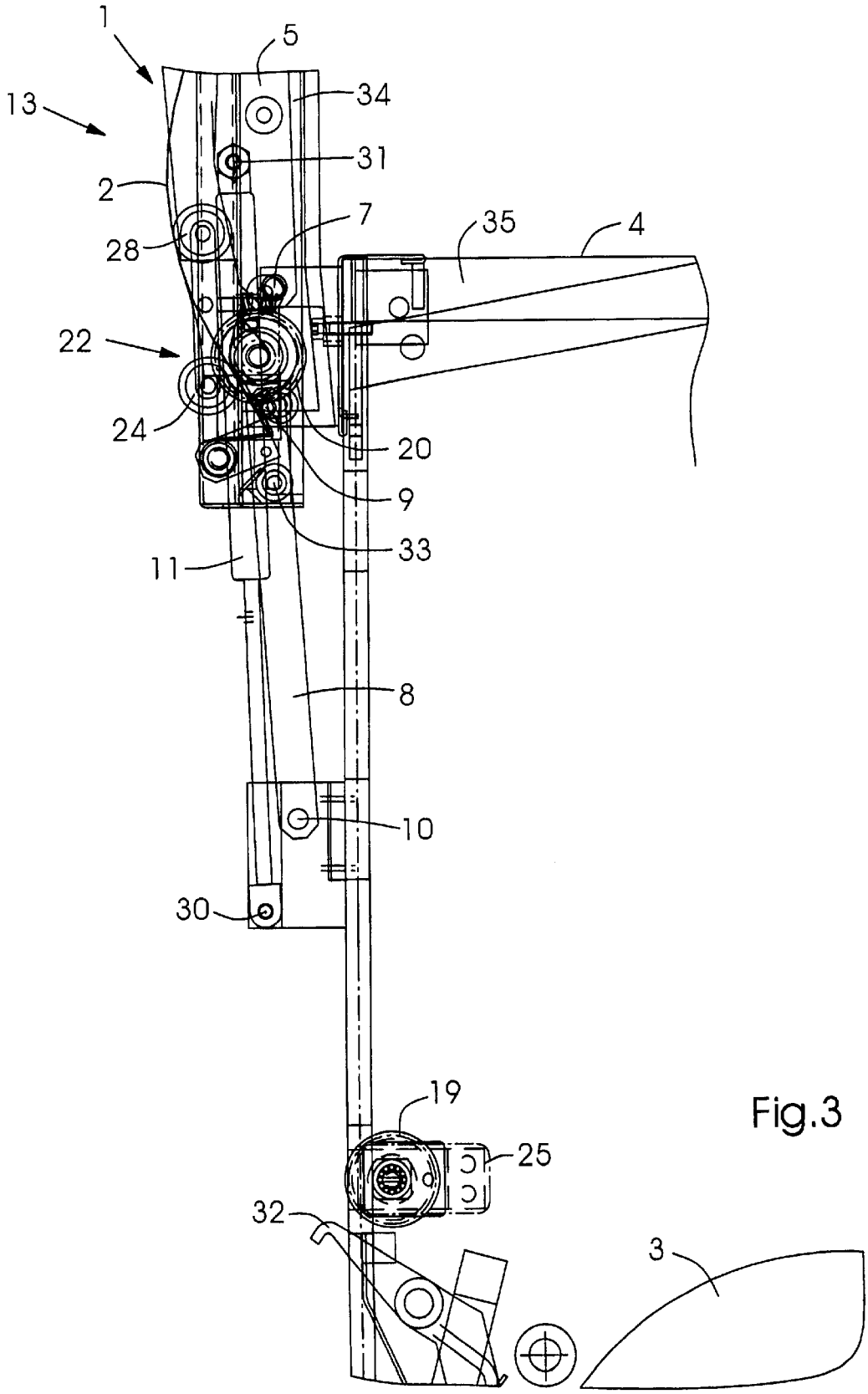
FIG. 3 is a fragmentary view of FIG. 2 showing the exemplary embodiment of the printing-plate changer assembly in open condition.

FIG. 3 shows a detail of the exemplary embodiment illustrated in FIG. 2, the printing-plate changer 1 being located in the swung-away position 13. Before the pivoting action is performed, the lock 32 has to be unlatched from the pin 33 by the pneumatic cylinder 29. The printing-plate changer 1 is then pivoted, in the manner described hereinbefore, relative to FIG. 1, the aforedescribed assistance by the gas pressure spring 11 being active. During this pivoting movement, the teeth of the gearwheel 20 are moved out of the teeth of the gearwheel 19 and, as a result, the introduction of mechanical energy is decoupled or disengaged.

Illustrated as an additional detail in FIG. 3 is the motor 25 which drives the gearwheel 19. Also illustrated is an ejection shaft 34 for used printing plates and a withdrawal clip 35, which is used to accept printing plates pushed by the plate cylinder 3 into the ejection shaft 34, and to pull those plates completely into the ejection shaft 34.

Figure 4:
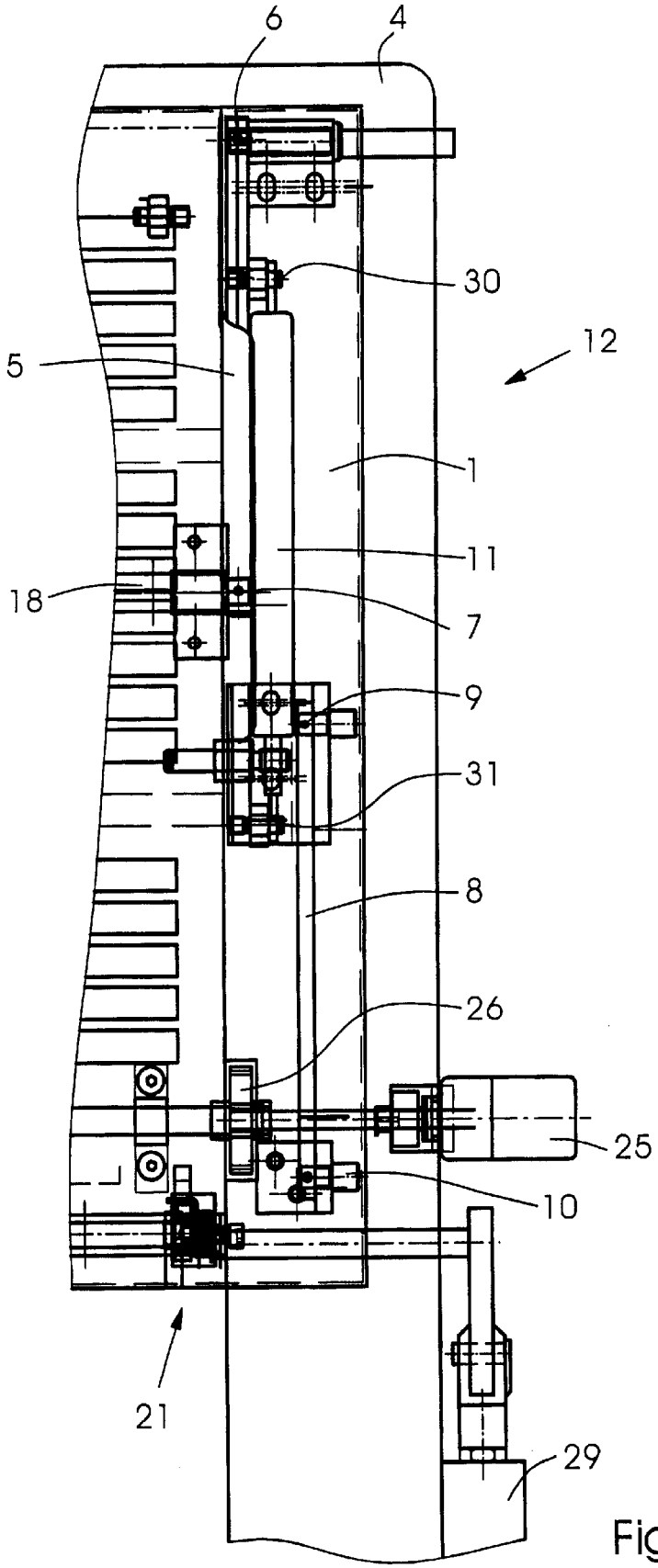
FIG. 4 is a fragmentary front elevational view of the exemplary embodiment.

FIG. 4 shows a further fragmentary view of the exemplary embodiment which has already been illustrated in FIGS. 2 and 3. This fragmentary view is shown from the front by comparison with FIGS. 2 and 3, i.e., in a viewing direction rotated through 90°. Those parts which have already been described hereinbefore bear the same reference numerals, and the printing unit 4 is shown with the printing-plate changer 1 closed, as was already illustrated in FIG. 2. Also illustrated in FIG. 4 is a synchronization shaft 18, which is arranged on the articulating connection 7 of the upper lever 5 to the printing-plate changer 1. FIG. 4 also shows the free wheel 26, which can be inserted at any desired location in the power transmission from the motor 25 to the pressure roller 23.

Figure 5B:
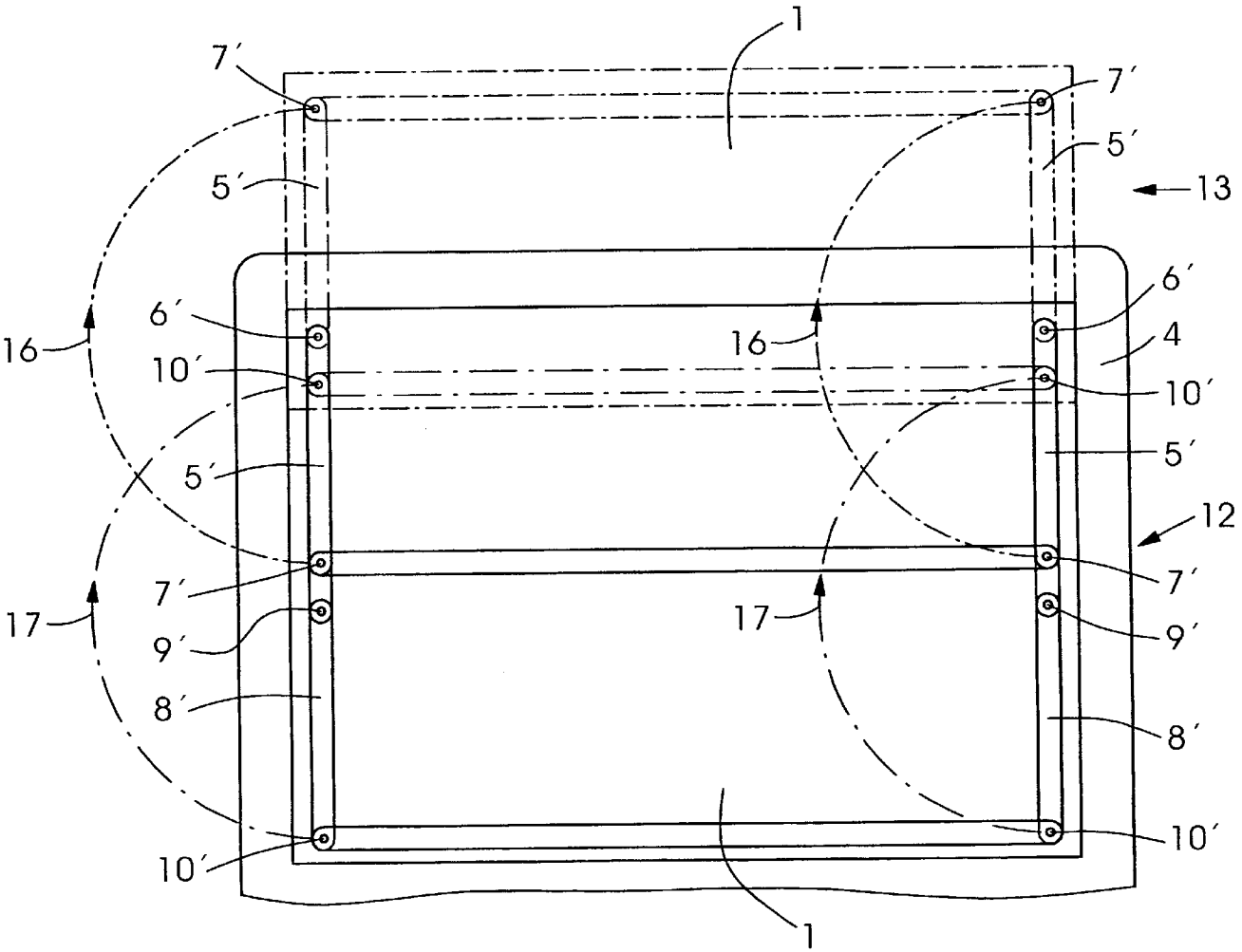
FIGS. 5*a* and 5*b* are basic sketches in respective side and front elevational views showing a second possibility for articulatedly connecting with four-bar linkages.
Figure 5A:
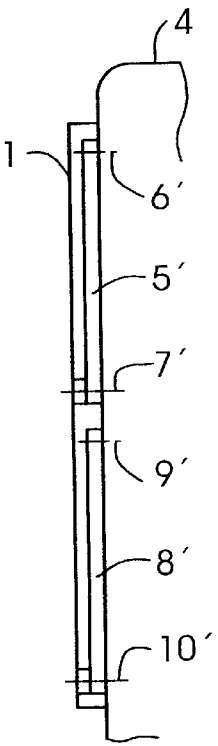

FIG. 5*a* (side view) and FIG. 5*b* (front view) show a basic sketch with a second articulation option using four-bar linkages 5' to 10'. Both the upper levers 5', which are arranged on both sides of the printing-plate changer 1, and the correspondingly arranged lower levers 8' can be pivoted parallel to the plane of the drawing in this articulation option. For this purpose, the articulations 6', 7', 9' and 10' are configured so that the axes of rotation run perpendicular to the plane of the drawing. In this way, the printing-plate changer 1 can be pivoted to the side in the plane of the drawing, and then upwardly into the position 13 shown in phantom, i.e., by dot-dash lines. This pivoting movement is indicated by the dot-dash semicircle 17, which shows the pivoting movement of the articulating connection 10' of the lower lever 8' with the printing-plate changer 1. In a corresponding manner, the dot-dash semicircle 16 shows the pivoting movement of the articulating connection 7' of the upper lever 5' with the printing-plate changer 1.

The element 11, constructed, for example, as a gas pressure spring or strut, is not shown in this basic sketch either. The arrangement corresponds to that shown in FIGS. 2 to 4, the element 11 likewise having to be rotated through 90° with respect to the articulation thereof and ability to be pivoted. In a corresponding manner, the oblique position described hereinabove is likewise set out in the plane of the drawing.

The illustration in the drawing is of course only exemplary. The functional principle shown in FIGS. 5*a* and 5*b* can be performed in a similar manner to the exemplary embodiment of FIGS. 2, 3 and 4 with appropriate reorganization. However, both functional principles in turn permit various configuration options. For example, it is also possible for an active element to be inserted which is matched to the forces of the sprung element 11 in such a way that the pivoting movement can be performed automatically. The introduction of power into the printing-plate changer 1 can also be performed in the different manner described at the introduction hereto.

I claim:

1. A printing-plate changer assembly for making-ready and feeding printing plates to a plate cylinder of a printing unit, the assembly comprising:

a printing-plate changer located upline of the printing unit, in a position for feeding the printing plates;

at least two four-joint linkages having a plurality of articulations, said linkages articulatedly connected with the printing unit and connecting said printing-plate changer to the printing unit for pivoting said printing-plate changer upwardly into a swung-away position for servicing work; and at least one element articulatedly connected with the printing unit and with said printing-plate changer for holding said printing-plate changer in both the feeding and the swung-away positions and assisting the pivoting of said printing-plate changer.

2. The printing-plate changer assembly according to claim 1, wherein said at least one element is formed as a sprung element and is articulated and aligned offset with respect to said articulations of said four-joint linkages, so that said at least one element urges the printing-plate changer downwardly into the position for feeding the printing plates and upwardly into the swung-away position, as well as away from a given pivoting angle.

3. The printing-plate changer assembly according to claim 2, wherein said at least one element is a gas pressure spring.

4. The printing-plate changer assembly according to claim 1, wherein said at least one element includes a plurality of elements disposed on both sides of the printing-plate changer.

5. The printing-plate changer assembly according to claim 1, wherein the printing-plate changer has means for replacing a printing unit guard, and the printing unit is accessible for substantially all servicing work due to the pivoting of said printing-plate changer.

6. The printing-plate changer assembly according to claim 1, further including an active element matched to forces of said at least one element for performing the pivoting of said printing-plate changer.

7. The printing-plate changer assembly according to claim 1, wherein said four-joint linkages have two upper levers and two lower levers for providing articulation, and said plurality of articulations interconnect said levers.

8. The printing-plate changer assembly according to claim 7, wherein the printing-plate changer has a substantially two-dimensional extent, and said plurality of articulations are formed so that the printing-plate changer completes the pivoting in a semicircle lying in the plane of the two-dimensional extent of the printing-plate changer.

9. The printing-plate changer assembly according to claim 7, wherein the printing-plate changer has a substantially two-dimensional extent, and said plurality of articulations are formed so that the printing-plate changer completes the pivoting in a semicircle lying perpendicularly to the plane of the two-dimensional extent of the printing-plate changer.

10. The printing-plate changer assembly according to claim 9, including a synchronization shaft for at least connecting one of the levers of one lever pair to one of the levers of another lever pair at one of said articulations.

11. The printing-plate changer assembly according to claim 1, including means for holding the printing plates after they have been used.

12. The printing-plate changer assembly according to claim 1, including a motor disposed in the printing unit, a first gearwheel disposed in the printing unit and driven by said motor, and a second gearwheel in said printing-plate changer, said first and second gearwheels intermeshing in a closed state for introducing power from said motor.

13. The printing-plate changer assembly according to claim 12, including a locking device for securing the intermeshing of said gearwheels.

14. The printing-plate changer assembly according to claim 1, including a printing-plate conveying device disposed in said printing-plate changer.

15. The printing-plate changer assembly according to claim 14, wherein said printing-plate conveying device has a pressure roller and a back-pressure roller which are pressable against one another by spring force, with one of the printing plates included therebetween.

16. The printing-plate changer assembly according to claim 14, including a motor for driving said printing-plate conveying device, said motor being disposed on the printing unit.

17. The printing-plate changer assembly according to claim 14, wherein said printing-plate conveying device has a free wheel for permitting one of the printing plates to be drawn in by rotation of the plate cylinder.

* * * * *